United States Patent [19]

Ahroni

[11] Patent Number: 4,779,177

[45] **Date of Patent: * Oct. 18, 1988**

[54] SERIES-PARALLEL CONNECTED MINIATURE LIGHT SET

[76] Inventor: Joseph M. Ahroni, 2701 W. Manor Pl., #204, Seattle, Wash. 98199

[ * ] Notice: The portion of the term of this patent subsequent to Feb. 23, 2003 has been disclaimed.

[21] Appl. No.: 945,602

[22] Filed: Dec. 22, 1986

Related U.S. Application Data

[63] Continuation-in-part of Ser. No. 664,153, Oct. 24, 1984, Pat. No. 4,631,650.

[51] Int. Cl.[4] ..... F21V 19/00

[52] U.S. Cl. ..... 362/236; 362/249; 362/806; 174/117 F; 313/51; 439/391

[58] Field of Search ..... 362/227, 236, 237, 238, 362/249, 252, 806; 174/117 F, 113 R, 114 R, 114 S; 313/1, 51, 250, 251, 267, 268, 272, 285; 315/288; 439/387, 391, 414, 417, 419, 425, 492, 505, 658, 659, 699

[56] References Cited

U.S. PATENT DOCUMENTS

| | | | |
|---|---|---|---|
| 1,974,472 | 9/1934 | Seghers | 362/249 |
| 2,506,620 | 5/1950 | Sundt | 362/249 |
| 3,206,712 | 9/1965 | Schick et al. | 439/419 |
| 3,214,579 | 10/1965 | Pacini | 362/227 |
| 3,551,723 | 12/1970 | Van Groningen | 362/227 |
| 3,601,767 | 8/1971 | Eckles | 439/419 |
| 3,609,643 | 9/1971 | Connan | 439/419 |
| 3,708,608 | 1/1973 | Wyman | 174/117 F |
| 3,867,621 | 2/1975 | Gewfrtz et al. | 362/147 |
| 3,873,885 | 3/1975 | Elfverson | 361/417 |
| 3,874,762 | 4/1975 | Shott et al. | 439/425 |
| 4,159,157 | 6/1979 | Koehler | 439/419 |
| 4,197,154 | 4/1980 | Pfaff, Jr. | 174/117 F |
| 4,263,640 | 4/1981 | Altman | 362/227 |
| 4,631,650 | 12/1986 | Ahroni | 362/249 |

*Primary Examiner*—Charles J. Myhre
*Assistant Examiner*—David A. Okonsky
*Attorney, Agent, or Firm*—Seed and Berry

[57] ABSTRACT

A series-parallel lighting string having a cord with three wires separated by insulation and a series of cutouts severing the center wire of the cord, and lampholders positioned at each of the cutouts to hold a miniature push-in type light bulb. Each of the lampholders has a pair of contact plates between which a bulb is inserted with its lead wires in contact with the plates. The contact plates are positioned within the housing of the lampholder, and the housing has a snap-fitting cap hingedly attached thereto to define a wireway. Each of the contact plates has an insulation-piercing contact finger positioned to engage one of the end portions of the severed wire to each side of the cutout in the cord. The first and last lampholders in each series set has a second cord-piercing contact finger which contacts one or the other of the outer non-severed wires. The cap or lampholder housing has an insulating divider which projects through the cutout to keep the severed end portions of the central wire separated. The center contact fingers of the pair of contact plates for a lampholder bridge the cutout. For the first and last lampholders, the other contact finger of the outer plate makes contact with one of the non-severed wires to provide a plurality of series sets of lampholders connected in parallel.

22 Claims, 3 Drawing Sheets

SERIES-PARALLEL CONNECTED MINIATURE LIGHT SET

DESCRIPTION

Related Applications

This application is a continuation-in-part of my copending application Ser. No. 664,153, filed Oct. 24, 1984 and now U.S. Pat No. 4,631,650.

Technical Field

The present invention relates to series-parallel strings of lights, and particularly to those having miniature push-in type bulbs operating at relatively low voltage.

Background Art

Decorative light strings in which all of the bulbs are in a single series has the disadvantage that if one bulb fails to light, the entire string goes out and it may be difficult to determine which light failed. Also, in a series string, the voltage available for each light is the line voltage divided by the number of bulbs. If, on the other hand, all the bulbs are in a parallel arrangement, failure of one of the bulbs does not affect the others, but each bulb is subjected to the full line voltage unless a transformer is used.

A suitable compromise between a series lighting circuit and a parallel lighting circuit is one in which sets of series-arranged bulbs are wired in parallel relation to make up a string. This is called a "series-parallel" string. In such a string, the voltage for each light is the line voltage divided by the number of bulbs in each set. If a bulb fails in a series-parallel string, only the bulbs in the series set containing that bulb will fail to light. Hence, there are fewer bulbs to check to find the faulty bulb than in a string where all the bulbs are in a single series string.

Normally, in a series-parallel string of miniature push-in type bulbs, the lampholders in each series set are interconnected by using multiple short lengths of insulated lead wire connected to contact plates in a manner similar to that shown, for example, in U.S. Pat. No. 3,104,924. The lead wires to and from the first and last lampholders in each series set are connected, respectively, to parallel wires from the wall plug. Alternatively, the connection to the parallel wires is made by interrupting the parallel wires at the first and last bulbs of each series set and connecting both interrupted ends to the appropriate contact plate of the first and last lampholders. Hence, assembly of a series-parallel string of miniature lights has involved the handling and end-stripping of many pieces of wire, and normally there has been a need to wind the series wires and the parallel wires together between the bulbs for ease of handling when applying the string to a Christmas tree.

Disclosure of Invention

The present invention provides an improved lampholder and insulated three-strand cord, making it unnecessary to use multiple short lengths of wire, thus making it faster to assemble a strong and easier to apply it to a Christmas tree.

In carrying out the invention, lampholder housings are provided with a snap-on cover at their base end which provides a wireway with the rest of the housing. Two contact plates in each lampholder have insulation-severing contact elements projecting into the wireway to pierce the insulation of the cord and make the proper electrical connection to the wire. The cord has three side-by-side wires separated by insulation, the outer two wires being the parallel wires of the circuit and the center wire providing the series connection wires. The center wire is preformed with cutouts for the lampholder locations.

In one embodiment of the invention each lampholder cover has cover fastening means passing through the respective cutout to separate the ends of the center wire exposed at the cutout as well as securing the cover in place. In another embodiment each cover has a pair of fastening means having a snap interfit within the housing and a divider element projecting into a respective of the cutouts in the center wire. As an alternative, this divider element may be provided by the lampholder housing.

Each contact plate has a center pointed contact finger to engage the center wire and make a series connection, except that the lead-in contact plate of the first lampholder in each series set and the lead-out contact plate of the last lampholder in each series set have a pointed contact finger arranged to engage the appropriate one of the two outer parallel wires so as to make the parallel connection for the series set.

BEST MODE FOR CARRYING OUT THE INVENTION

Figure 2:
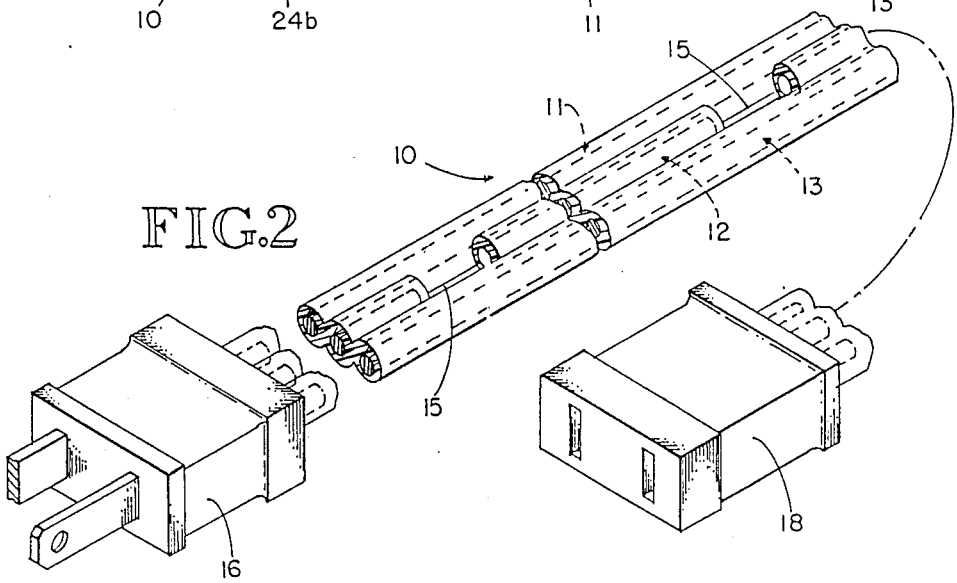
FIG. 2 is an isometric view showing a power cord with cutouts used with the present invention.

As part of the invention, there is provided an insulated cord 10 having three wires 11, 12, and 13 arranged in generally coplanar relation as a ribbon and separated by insulation 14 as shown in FIG. 2. The cord 10 has a series of cutouts 15 severing and passing through the center wire 12 and spaced apart along the length of the cord according to the desired spacing of the lampholders. At its ends, the cord 10 is provided with a wall plug 16 and an add-on socket 18. The outer two wires 11, 13 are electrically connected to the two contacts of the plug 16 and socket 18, and the center wire 12 dead-ends within the plug and socket.

Each lamp unit of the invention has a miniature push-in type lamp assembly 19 comprising a bulb 20 and a lamp base 22 in which the lamp 20 is mounted, and has a lampholder unit 24 receiving the lamp base. The lampholder unit 24 has a husk or housing 26, two conductor plates 28—28 or **28–28*a*, and a cover 30**.

As is common in the decorative lighting string art, each lamp 20 seats in a socket **22*a* in the lamp base 22 and has a pair of wire leads 20*a* extending therefrom. These leads 20*a* each extend through respective open passages 22*b* from the socket 22*a* of the lamp base 22 and double back over a pair of flat external end cheeks 22*c* stepped inwardly from a cylindrical portion 22*d* surmounted by a gripping rim 22*c***.

The lampholder housing 26 has a cylindrical socket portion **26*a* to receive the cylindrical portion 22*d* of the lamp base 22, and has a rectangular bore extension 26*b* defined by two pairs of faces 26*c*—26*c* and 26*d*—26*d*. Two conductor plates 28—28, or 28–28*a* as the case may be, are positioned in front of the extension faces 26*c* and are retained along their longitudinal side edge portions by keeper grooves 26*e* formed in the housing 26 at the four corners of the rectangular bore extension 26*b*. At the base of the housing 26 the parallel faces 26*d* of the bore extension 26*b* terminate at a pair of recessed transverse stop ledges 26*f*. Outwardly of each of these ledges 26*f* the base of the housing 26 has three arcuate wireway grooves 26*g*, 26*h*, and 26*i* for fitting around the insulation of the three wire portions 11–13 of the cord 10**.

Figure 7:
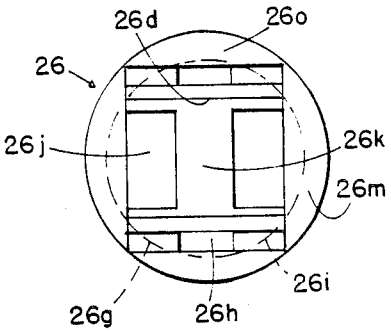
FIG. 7 is a bottom plan view of the lampholder housing before insertion of the conductor plate elements.
Figure 8:
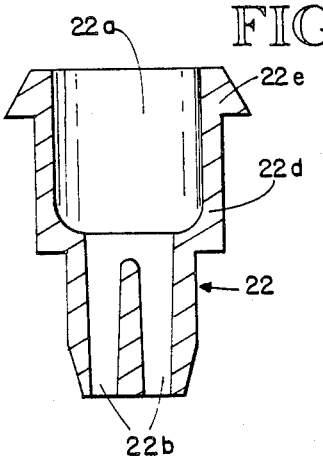
FIG. 8 is a longitudinal sectional view of the lamp base.
Figure 9:
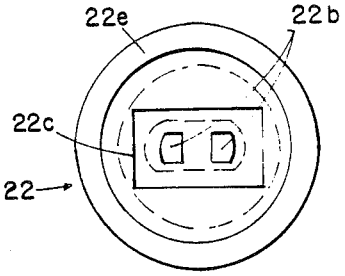
FIG. 9 is a bottom plan view of the lamp base.
Figure 12:
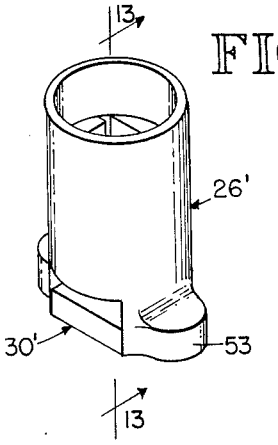
FIG. 12 is a perspective view of a modified housing and cover assembly.

The pair of bore extension faces **26*c* terminate at the bottom at the level of the upper faces of a pair of opposed rectangular retaining lips 26*j*—26*j* separated by a central entry 26*k* which extends to the bore extension faces 26*d*–26*d*. As shown in FIG. 7, the narrowed side edges of the retaining lips 26*j* are separated from the bore extension faces 26*d*–26*d* by gaps 26*m* which at their outer closed ends are downward continuations of the corner grooves 26*e*. The gaps 26*m* receive the contact plates 28 which are positioned in the lamp housing 26 by sliding them endwise upwardly through the gaps 26*m* and into the corner grooves 26*e*. To restrict upward movement of the contact plates 28 they are formed with narrow stop flanges 28*d* arranged to engage the stop ledges 26*f* when the contact plates are in proper position within the housing 26**.

Extending downwardly below the retaining lips **26*j*–26*j* the housing has a pair of base extensions 26*n*–26*n* with flat opposed vertical faces defining the longitudinal sides of a wireway. The ends of the wireway are at a pair of base faces 26*o*–26*o* which are coplanar with the bottom faces of the retaining lips 26*j***.

Figure 5:
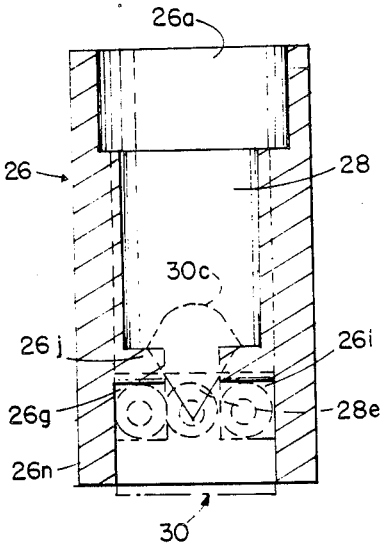
FIG. 5 is a longitudinal sectional view of the lampholder taken as indicated by line 5—5 of FIG. 4, but with the cover shown in phantom.
Figure 6:
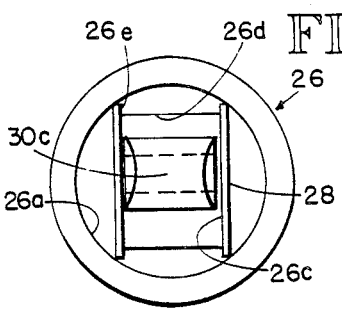
FIG. 6 is a top plan view of the lampholder with the cover in operative position.

The cover member 30 has a rectangular base **30*a* of a size to fit between base elements 26*n* and cover the wireway to the base faces 26*o*. In the first embodiment, the cover 30 has a central projecting divider leg 30*b* formed with a tapered keeper head 30*c*. This head is formed with a pair of keeper faces 30*d* at opposite sides for engaging the upper faces of the retaining lips 26*j* as shown in phantom in FIG. 5. The housing 26 and cover 30 are injection molded plastic selected to have sufficient resiliency to permit the keeper head 30*c* to snap fit into position responsive to pushing through the entry 26*k* between the retaining lips 26*j***.

Figure 3:
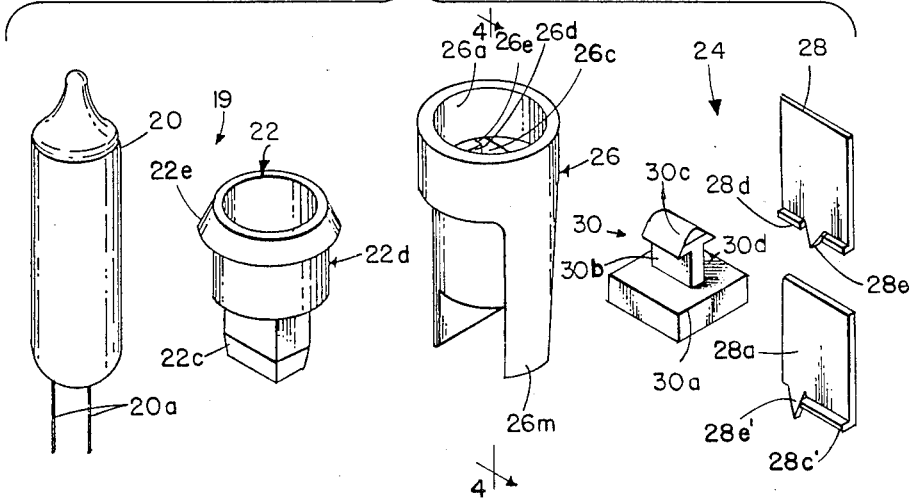
FIG. 3 is an exploded isometric view of a lamp unit of the present invention for use in the light string of FIG. 1.
Figure 4:
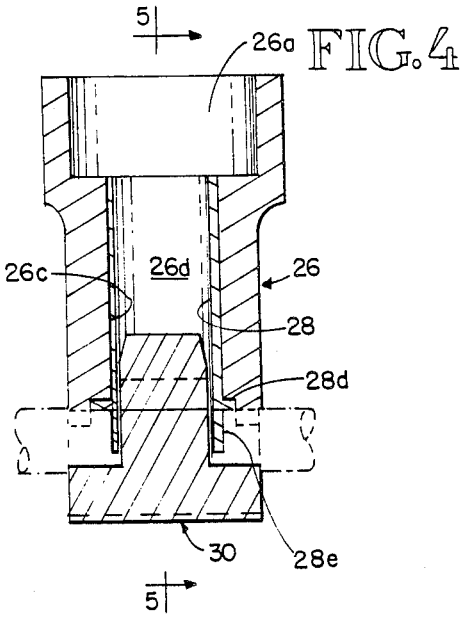
FIG. 4 is a longitudinal sectional view of the lampholder taken as indicated by line 4—4 in FIG. 3.
Figure 10:
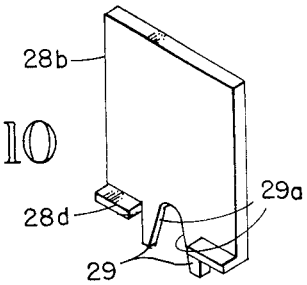
FIG. 10 is a perspective view of a modified contact plate.
Figure 11:
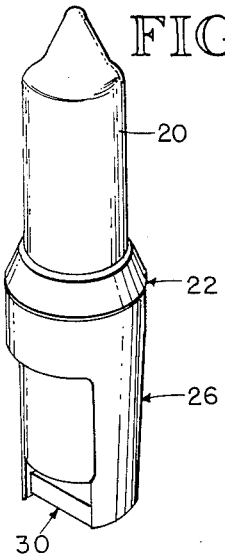
FIG. 11 is a perspective view of the lampholder assembly of FIG. 3 in assembled condition.

Referring to FIG. 3, there is shown two forms of contact plates 28: plate 28 with a central insulation-piercing pointed element **28*e*, and a pair of stop flanges 28*d*, and plate 28*a* with an offset pointed element 28*e*′ and a single stop flange 28*d*′. As an alternative to a single pointed contact element, the contact plates 28, for example, may have a pair of tapered fingers 29 which have opposed insulation-severing edges 29*a* as shown in FIG. 10 on contact plate 28*b*. These fingers 29 are adapted to pierce the insulation around the center wire 12 until the wire nests at the narrow end of the slot 29*b* between the fingers 29**.

When assembling the light string the covers 30 may be positioned with the divider legs **30*b* passing through the cutouts 15 in the cord 10. Then the covers and cord can be positioned in the wireways of the housings 26 between the base extensions 26*n* whereupon the covers and housings can be pressed together to give them a snap fit. This pressure also forces the pointed contact elements through the cord insulation 14 into wire contact so that a circuit will be completed to the leads 20*a* of the lamps 20**.

Figure 1:
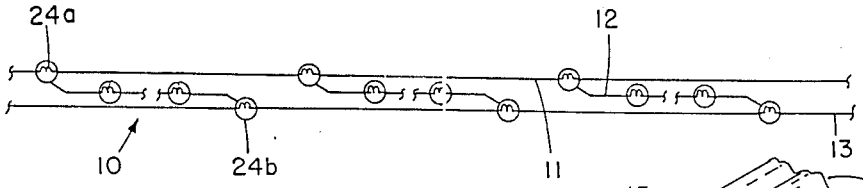
FIG. 1 is a schematic drawing of a series-parallel light string which is achieved using the present invention.

As indicated in FIG. 1, multiple sets of the lampholders 24 are placed in series with respect to center wire 12 between the parallel wires 11, 13. All of the lampholders 24 in each series set, except lampholders **24*a*, 24*b* at the two ends of the series set, have a pair of the contact plates 28 with the center contact elements 28*e* arranged to make contact with the center wire 12 on opposite sides of the cutouts 15. The end lampholders 24*a*, 24*b* only have one of the contact plates 28 with the center contact element 28*e* arranged to make contact with the center wire 12. Each end lampholder 24*a* has one of the contact plates 28*a* with its offset contact element 28*e*′ arranged to make contact with wire 11, and each end lampholder 24*b* has one of the contact plates 28a with its offset contact element 28*e* arranged to make contact with wire 13. It will be apparent that end lampholders 24*a*, 24*b* in FIG. 1 can be identical, but turned a half turn relative to one another with respect to their connections to the center wire 12**.

Figure 13:
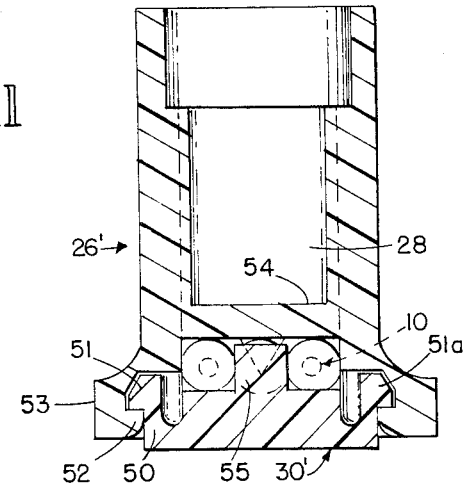
FIG. 13 is a vertical sectional view taken as indicated by line 13—13 in FIG. 12.
Figure 14:
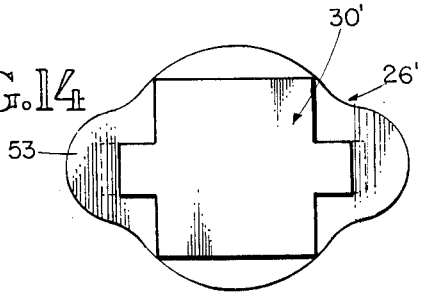
FIG. 14 is a bottom plan view of the assembly of FIG. 12.
Figure 15:
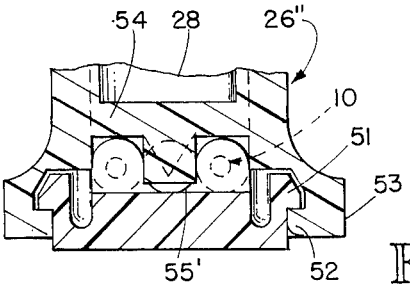
FIG. 15 is a fragmentary sectional view taken like FIG. 13 and showing a modified divider arrangement.

As an alternative to the snap fit between the cover and housing achieved by the keeper head **30*c* in conjunction with the retaining lips 26*j*, the cover may have a snap interfit with the housing by way of a pair of locking legs 50 each having an outwardly extending locking foot 51 which is adapted to snap fit with a respective retaining lip 52. Such an arrangement is shown in FIG. 13 in which the modified housing 26′ has a pair of hollow bottom lateral extensions 53 on base elements 26*n* which are partially closed at the bottom by the retaining lips 52. The locking feet 51 on the modified cover 30′ have beveled outer faces 51*a* to guide them into position while the parts deflect sufficiently for the snap interfit. In this arrangement a bottom wall 54 is provided in place of the two retaining lips 26*i* and this opposed by a divider wall 55 on the cover 30′ for extending into the cord cutouts 15. As shown in FIG. 15 on housing 26′, the divider wall 55 can also be provided by the housing as a downward projection 55′ from the bottom wall 54**.

From the foregoing it will be appreciated that, although specific embodiments of the invention have been described herein for purposes of illustration, various modifications may be made without deviating from the spirit and scope of the invention. Accordingly, the invention is not to be limited except as by the appended claims.

I claim:

1. A lampholder assembly for use with insulated conductors, comprising:

a housing having a socket at one end to receive a lamp unit and a base at the opposite end;

a pair of contact members at opposite sides of the socket and having insulation severing portions at the base of the housing for conductor engagement;

a cover at the base of the housing and providing with the housing a covered wireway into which said severing portions of the contact members project; and cover securing means extending from the cover through the wireway and interfitting with the housing.

2. A lampholder according to claim 1 in which said housing and cover are plastic and said cover securing means is integral with the cover and has a snap interfit with the housing.

3. A lampholder assembly for use with insulated conductors, comprising:

a housing having a socket at one end to receive a lamp unit;

a pair of contact members at opposite sides of the socket and having insulation severing portions at the base of the housing generally opposite the socket for conductor engagement;

a cover at the base of the housing and providing with the housing a covered wireway into which said severing portions of the contact members project;

two insulated wires passing through said wireway and making contact with said severing portions, said insulated wires being spaced apart endwise within said wireway; and cover securing means extending from the cover through the wireway between the insulated wires and interfitting with the housing.

4. A lampholder assembly for use with insulated conductors, comprising:

a plastic housing having a socket at one end to receive a lamp unit and having a base at the opposite end;

a pair of contact members at opposite sides of the socket to engage the lamp unit and having insulation severing portions at the base of the housing for conductor engagement; and a plastic cover at the base of the housing collectively providing with the housing a covered wireway into which said severing portions of the contact members project, said cover having an integral central leg passing through a central portion of the wireway and having cover securing means interfitting with the housing.

5. A lampholder assembly according to claim 4 in which said cover securing means comprises an enlarged foot on said leg which has a snap interfit with the housing.

6. A lampholder assembly according to claim 4 in which said cover securing means comprises a pair of locking legs integral with said cover and located at opposite sides of said wireway and central leg, said locking legs each having an enlarged foot which has a snap interfit with said housing.

7. A lighting string comprising:

an insulated cord having two wires separated by insulation, said cord having a series of cutouts severing one of said wires;

a series group of lampholders each having a wireway with a cover, said cord passing through said wireways and said covers having fasteners passing through said cutouts into said lampholders;

an end lampholder having a wireway with a cover, said cord passing into said wireway of the end lampholder, said cover of the end lampholder having a fastener passing through the wireway of the end lampholder into the end lampholder;

a pair of respective contact members in each of the lampholders in said series group, each such pair passing through the insulation of the cord and making electrical contact in the wireways with the severed wire on opposite sides of the respective said fastener;

two contact members in said end lampholder passing through the insulation of said cord, one of said two contact members making electrical contact with the severed wire and the other of said two contact members making electrical contact with the other of said wires; and a light bulb in each of the lampholders having operative electrical connection with the contact members of the respective lampholder.

8. A lighting string according to claim 7 in which said lampholders and covers are plastic and said fasteners are integral with said covers and have a snap interfit with the lampholders.

9. In a lighting string:

a plurality of lamp units, each having a wireway therethrough;

a cord extending through the wireways and having three coplanar wires separated by insulation; and a series of cutouts in the cord severing the center one of the three wires and located entirely within said wireways.

10. In a lighting string according to claim 9, said lamp units each comprising a lampholder and a cover over the respective wireways, and fasteners securing the covers to the lampholders and passing through said cutouts.

11. In a lighting string according to claim 10, said fasteners having a snap fit with said lampholders within the lampholders.

12. A lampholder comprising:

a housing having a socket at one end to receive a lamp unit and a channel at the opposite end;

a pair of parallel spaced contact members exposed to said socket and slidably interfitting with the housing in crosswise relation to the length of the channel, said contact members having insulation severing portions projecting into said channel;

means restricting movement of the contact members in the housing toward the socket end thereof, said housing having integral transverse wall means located between said contact members and between the socket and the channel; and a cover in the channel and spaced from the channel bottom so that a wireway extends lengthwise through the channel and has said severing portions of the contact members projecting thereinto; and cover securing means projecting from said cover between said contact members toward said socket and retained by said transverse wall means.

13. A lampholder according to claim 12 in which said cover securing means comprises a leg integral with said cover and having a foot which has a snap interfit with said transverse wall means.

14. A lampholder according to claim 12 in which said cover securing means comprises a fastener extending from the cover into said transverse wall means.

15. A lampholder according to claim 14 in which said fastener is integral with the cover.

16. A lampholder assembly for use with insulated conductors, comprising:

a housing having a socket at one end to receive a lamp unit and a base at the opposite end;

a pair of contact members at opposite sides of the socket and having insulation severing portions at the base of the housing for conductor engagement;

a cover at the base of the housing and providing with the housing a covered wireway into which said severing portions of the contact members project;

two cover securing means extending from the cover at opposite sides of the wireway and interfitting with the housing within the confines of the housing; and a central element interrupting a central portion of the wireway midway between said cover securing means, said central element being spaced from the sides and ends of said wireway.

17. A lampholder according to claim 16 in which said housing and cover are plastic and said cover securing means are integral with the cover and have a snap interfit with the housing.

18. A lampholder assembly for use with insulated conductors, comprising:

a plastic housing having a socket at one end to receive a lamp unit and having a base at the opposite end;

a pair of contact members at opposite sides of the socket to engage the lamp unit and having insulation severing portions at the base of the housing for conductor engagement;

a plastic cover at the base of the housing collectively providing with the housing a covered wireway into which said severing portions of the contact members project, said cover having a snap interfit with the housing at opposite sides of the wireway; and a central element passing through a central portion of the wireway and spaced from the sides and ends of the wireway.

19. A lampholer assembly according to claim 18 in which said central element is integral with said cover and projects therefrom into the wireway.

20. A lampholder assembly according to claim 18 in which said central element is integral with the housing and projects into the wireway.

21. In a lighting string:

a plurality of lampholders, each having a wireway therethrough;

a cord extending through the wireways and having three coplanar wires separated by insulation;

a series of central openings in the cord through the center one of the three wires and located entirely within said wireways;

two contact elements in each lampholder on opposite ends of said central openings and contacting said center wires; and bulbs in the lampholders operatively engaging said contact elements and bridging said central openings.

22. In a lighting string according to claim 21 insulating elements extending from the lampholders into said central openings.

* * * * *